US011702813B2

(12) United States Patent
White

(10) Patent No.: US 11,702,813 B2
(45) Date of Patent: Jul. 18, 2023

(54) METHOD AND APPARATUS FOR FORMING CEMENTED GROUND SUPPORT COLUMNS

(71) Applicant: Geoqore, LLC, Northfield, MN (US)

(72) Inventor: David J. White, Northfield, MN (US)

(73) Assignee: Geoqore, LLC, Northfield, MN (US)

( * ) Notice: Subject to any disclaimer, the term of this patent is extended or adjusted under 35 U.S.C. 154(b) by 0 days.

(21) Appl. No.: 17/398,056

(22) Filed: Aug. 10, 2021

(65) Prior Publication Data

US 2021/0363721 A1 Nov. 25, 2021

Related U.S. Application Data

(63) Continuation of application No. 16/753,930, filed as application No. PCT/US2018/054384 on Oct. 4, 2018, now Pat. No. 11,085,163.

(60) Provisional application No. 62/568,948, filed on Oct. 6, 2017.

(51) Int. Cl.

| | |
|---|---|
| ***E02D 5/38*** | (2006.01) |
| ***E02D 5/44*** | (2006.01) |
| ***E02D 5/66*** | (2006.01) |
| ***E02D 17/12*** | (2006.01) |
| ***E02D 27/12*** | (2006.01) |
| ***E04C 3/34*** | (2006.01) |
| ***E04C 3/36*** | (2006.01) |
| ***E04G 13/02*** | (2006.01) |

(52) U.S. Cl.

CPC ..... *E02D 5/44* (2013.01); *E02D 5/66* (2013.01); *E02D 17/12* (2013.01); *E02D 27/12* (2013.01); *E04C 3/34* (2013.01); *E04C 3/36* (2013.01); *E04G 13/02* (2013.01); *E02D 2250/003* (2013.01); *E02D 2250/0023* (2013.01)

(58) Field of Classification Search

CPC .. E02D 3/08; E02D 5/44; E02D 5/385; E02D 5/66; E02D 17/12; E02D 27/12; E02D 2250/0023; E02D 2250/003; E04C 3/34; E04C 3/36; E04G 13/02

See application file for complete search history.

(56) References Cited

U.S. PATENT DOCUMENTS 2,968,915 A 1/1961 Feistel
3,805,535 A * 4/1974 Van Weele ..... E02D 5/385 405/237
4,618,289 A 10/1986 Federer
(Continued)

OTHER PUBLICATIONS

International Search Report and Written Opinion issued in counterpart PCT Application No. PCT/US2018/054384 dated Dec. 14, 2018 (eleven (11) pages).

*Primary Examiner* — Carib A Oquendo
(74) *Attorney, Agent, or Firm* — Maynard Nexsen PC; E. Eric Mills; Todd A. Serbin

(57) ABSTRACT

A method and apparatus for forming cemented ground support columns is disclosed. Namely, driving mandrels are provided for the efficient construction of incrementally enlarged diameter support columns. For example, the driving mandrel includes a feed tube that has a top portion and an expansion head portion. The expansion head portion further includes an expansion (or compaction) chamber and a flexible tubular egress port. Further, construction methods are provided of using the driving mandrels for the efficient construction of incrementally enlarged diameter support columns.

18 Claims, 7 Drawing Sheets

(56) References Cited

U.S. PATENT DOCUMENTS

| | | | | |
|---|---|---|---|---|
| 6,672,408 | B2 * | 1/2004 | Frantz | E02D 9/02 175/69 |
| 2004/0115011 | A1 | 6/2004 | Fox | |
| 2008/0205993 | A1 | 8/2008 | Wissmann et al. | |
| 2016/0208452 | A1 * | 7/2016 | Verdin | E02D 7/24 |
| 2016/0312430 | A1 | 10/2016 | Wissmann | |
| 2021/0164185 | A1 * | 6/2021 | White | E01C 21/00 |

* cited by examiner

METHOD AND APPARATUS FOR FORMING CEMENTED GROUND SUPPORT COLUMNS

CROSS-REFERENCE TO RELATED APPLICATIONS

The presently disclosed subject matter is a continuation and claims priority to U.S. patent application Ser. No. 16/753,930 filed Apr. 6, 2020, which is a 35 U.S.C. § 371 U.S. national phase entry of International Application No. PCT/US2018/054384 having and international filing date of Oct. 4, 2018, which is related to and claims priority to U.S. Provisional Patent Application No. 62/568,948 entitled "Methods and Apparatus for Building Cemented Ground Support Columns" filed on Oct. 6, 2017; the entire disclosure of which are incorporated herein by reference.

TECHNICAL FIELD

The presently disclosed subject matter relates generally to concrete support columns and more particularly to a method and apparatus (e.g., driving mandrels) for forming cemented ground support columns.

BACKGROUND

Deep foundations have been used for centuries to support bridges, buildings, and other heavy structures on soft ground. Historically, deep foundations consisted of timber pilings driven into the ground using drop hammers. In more modern times, timber piles have been replaced with driven precast concrete pilings or steel pilings that offer a longer useable life and higher support capacities. Cast-in-drilled-hole concrete piers (also known as "drilled piers", "drilled caissons," or "drilled shafts") have been used for over a hundred years to provide support for heavy loads with application for highway bridge supports. These piers may be constructed in dry holes or may be constructed in holes drilled below the ground water level provided that temporary stabilization measures such as casings or drilling fluids are used in construction. Cast-in-drilled hole pilings are advantageous because they have high support capacities but have the drawback that they are difficult to construct particularly when the designer wishes to have a higher-end bearing surface than afforded by the drilling tool.

Although auger belling tools, that rake outward and expand the bottom of the pier to a cross sectional area larger than the shaft of the pier, are implemented at many sites with dry soil conditions or with stiff low-permeability cohesive soils, the construction of such piers in soft ground conditions or in granular and collapsible materials is difficult and may lead to construction deficiencies. At dry soil sites or at sites with subsurface materials consisting mainly of stiff low-permeability clay soils, belling tools are used within cast-in-drilled-hole installations to expand the cross-sectional area at the bottom of the pier. In soft ground conditions or in granular soils, however, these tools can lead to ground loss and failure unless the subsurface materials are stabilized with drilling fluids that require extensive skill to employ. What is needed is a method that robustly allows for the construction of piers with differing diameters in many applicable soil conditions.

Auger-cast piles have been used in the United States since the 1950's and are installed by drilling continuous-flight augers into the ground and extracting the augers while backfilling the cavities with fluid grout. Auger cast piles may be constructed relatively quickly but have the disadvantage that the piles may have quality control issues with "necking" (reduced pile cross section) during auger extraction. Further, auger-cast pilings can be constructed with one nearly-uniform diameter only. What is needed is a method that robustly allows for the construction of cast-in-place inclusions with increased quality control relative to pier necking and the ability to create expanded diameters at selected depths.

Controlled modulus columns are a method described in U.S. Pat. No. 6,672,015, entitled "Concrete Pile Made of Such a Concrete and Method for Drilling a Hole Adapted for Receiving the Improved Concrete Pile in a Weak Ground," and consist of inserting a reverse-rotation displacement auger into the ground, which has the advantage that it produces little cuttings, while backfilling the cavities with cementitious ground during extraction. These elements develop little cuttings at the ground surface because of the reverse auger rotation but have the same disadvantages as described above for auger-cast pilings. Like auger-cast piles, controlled modulus columns may be constructed with one uniform diameter only and with little potential for creating piers of incrementally varying diameters.

Other ground improvement methods currently exist in the field including the tamper head driven mandrel with restrictor elements (e.g., U.S. Pat. No. 7,604,437, entitled "Method and Apparatus for Creating Support Columns Using a Hollow Mandrel with Upward Flow Restrictors") that is used primarily for the placement of aggregate in the ground for ground improvement applications. This method offers the advantage that the restrictor elements may be used to prevent upward flow of the aggregate in the mandrel, a feature that facilitates the construction of compacted bulbs of aggregate during downward driving through the placed stone. As further described in U.S. Pat. No. 9,637,882, entitled "Method and Apparatus for Making an Expanded Base Pier," the restrictor elements may further be applied to the construction of below-grade low-slump concrete elements whereby the restrictor elements are used to create a bottom bulb. The restrictor elements used in this art is effective for preventing the upward flow of stone or low-slump concrete but is ineffective in high slump concrete or cementitious grout because more fluid infill materials easily move past the restrictor elements.

Similarly, concrete ground improvement elements may also be constructed below grade and the bottom bulb may be expanded using the system described in the '882 patent provided that the concrete infill materials contain sufficient amounts of coarse aggregate and are applied at using a sufficiently low slump to allow the restrictor elements to engage the concrete. This system cannot be effectively used, however, with fluid-like infill materials such as high-slump concrete, sand-cement grout and sand-polymer grout mixtures that are much easier to pump but do not contain sufficient coarse aggregate or a low enough slump for the restrictor elements to bind with the material. What is needed is a method that can be used to create below-grade expanded diameters within piers constructed from fluid cemented infill materials with or without strengthening fiber additives. What is further needed is a means of constructing high-capacity cast-in-situ concrete pilings with high confidence quality control and the ability of constructing piers with differing diameters at varying depths to enhance load transfer to competent soils.

SUMMARY

The present subject matter relates to systems, apparatuses, and methods for constructing a support column. A driving mandrel has a top portion, a feed tube, and an expansion head portion that are operatively connected. The expansion head portion comprises an expansion chamber and a tubular egress port within the expansion chamber, the tubular egress port is configured to crimp or compress radially inwards to prevent backflow of infill material upward into the tubular egress port.

The top portion may have an open upper end to the feed tube or an upper end that is closed, such as by a lid, and the expansion chamber has an open lower surface. Optionally, the top portion includes an inlet injection port, a pressure gauge, and a pressure relief valve.

The expansion head portion may include an internal connection ring to which the tubular egress port is affixed such that the tubular egress port extends into the expansion chamber. The tubular egress port may be made of a material selected to be sufficiently flexible for crimping, including with limitation, concrete hose, Kevlar tubing, or aramid fiber tubing.

The invention may comprise a feed tube that is cylindrical, or that has different geometric cross-sections. The feed tube has an inside diameter and an outside diameter, and the expansion chamber has an inside diameter and an outside diameter, such that the expansion chamber inside diameter may be greater than the feed tube outside diameter.

A method for constructing a support column may comprise the steps of: providing a mandrel assembly having a feed tube operatively connected to an expansion head, wherein the expansion head comprises an expansion chamber and an egress port within the expansion chamber, the egress port being adapted for crimping; driving the mandrel assembly into a ground surface to a prescribed initial depth with respect to the ground surface level; adding infill material to the feed tube, wherein the infill material has sufficient mobility for advancing within the feed tube and through the egress port; driving the mandrel assembly further into the ground surface to a prescribed driving termination depth with respect to the ground surface level; raising the mandrel assemble above the prescribed driving termination depth; forming a space at the bottom of the mandrel assembly; allowing a first portion of the infill material to exit through the egress port by gravity into the expansion chamber and into the space; and forming a first placed infill material at the prescribed driving termination depth.

The method adding step may be done by pumping the infill material into the feed tube. The method may further comprise the step of constructing an expanded diameter of the first placed infill material. The constructing step may include the steps of: re-driving the raised mandrel assembly downwards into the first placed infill material; crimping and constricting by the egress port to prevent upward movement into the egress port by the first placed infill material; and allowing the expansion chamber to push the first placed infill material downward and outward at a prescribed expanded diameter ground depth with respect to the ground surface level.

The method may further comprise the step of raising the mandrel assembly above the expanded diameter of the first placed infill material, and allowing a second portion of the infill material to exit through the egress port by gravity into the expansion chamber. The method may further comprise the steps of constructing a shaft above the expanded diameter of the first placed infill material.

A method may comprise the steps of providing a mandrel assembly having a feed tube operatively connected to an expansion head, wherein the expansion head comprises an expansion chamber and an egress port within the expansion chamber, the egress port being adapted for crimping; driving the mandrel assembly into a ground surface to a prescribed initial depth with respect to the ground surface level; adding infill material to the feed tube, wherein the infill material has sufficient mobility for advancing within the feed tube and through the egress port; driving the mandrel assembly further into the ground surface to a prescribed driving termination depth with respect to the ground surface level; raising the mandrel assembly above the prescribed driving termination depth; forming a space at the bottom of the mandrel assembly; allowing a first portion of the infill material to exit through the egress port by gravity into the expansion chamber and into the space; forming a first placed infill material at the prescribed driving termination depth; forming a second placed infill material at a different depth than the prescribed driving termination depth; forming a second placed infill material having a different diameter than the first placed infill material and at a different depth than the prescribed driving termination depth.

The method may further comprise the step of compacting the first placed infill material to have a diameter a larger than the diameter of the expansion chamber.

BRIEF DESCRIPTION OF DRAWINGS

Figure 1:
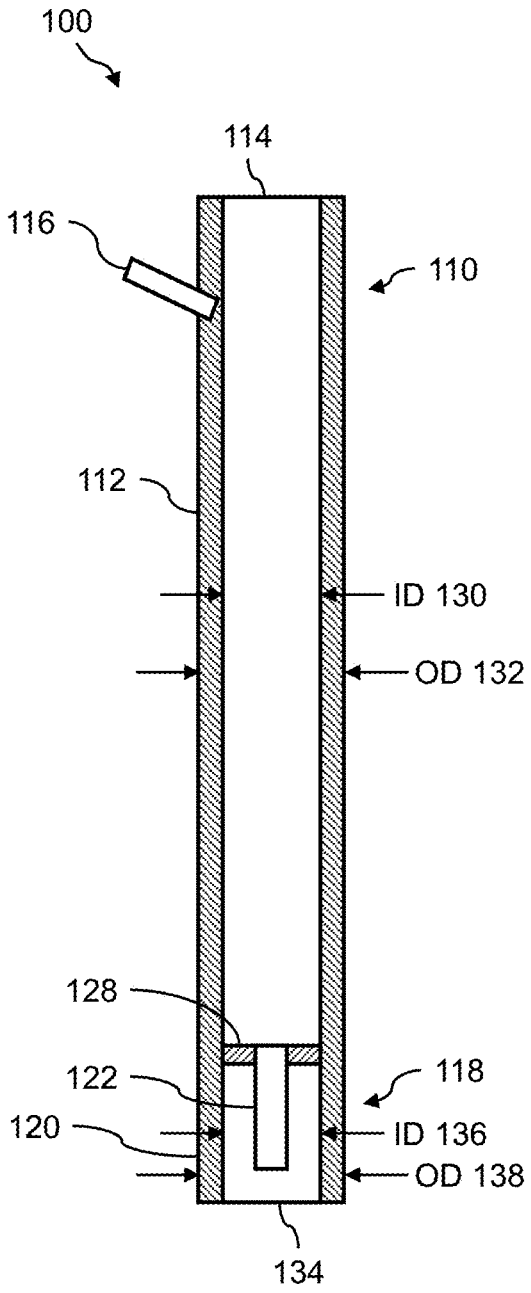
Figure 2:
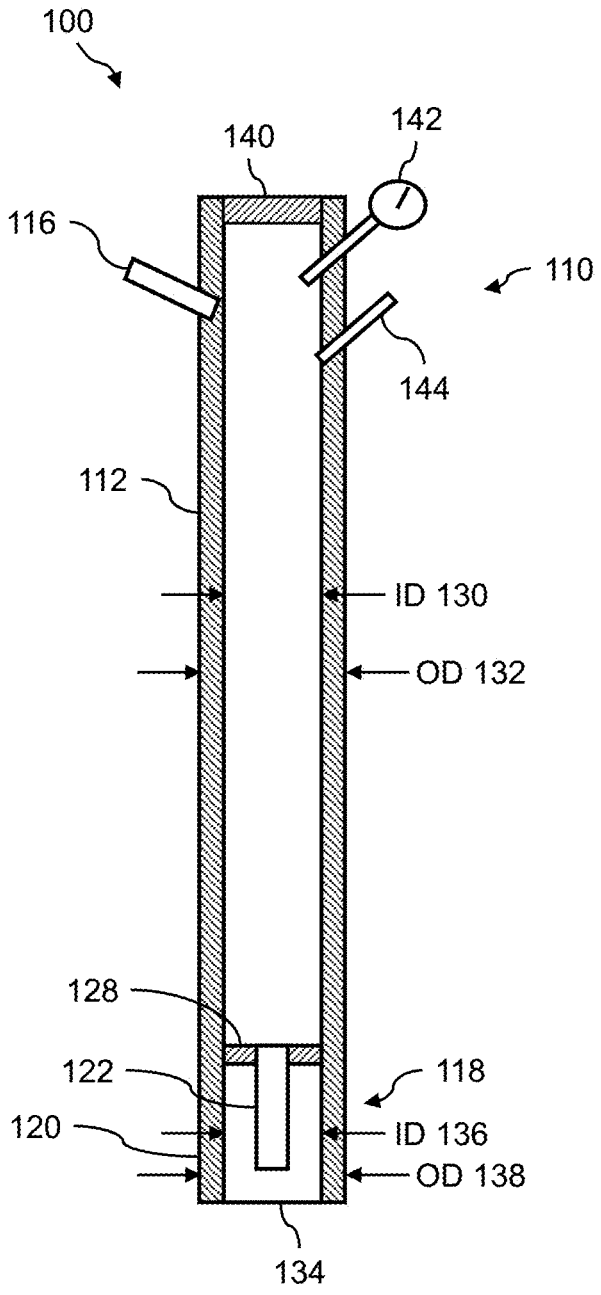
Figure 3A:
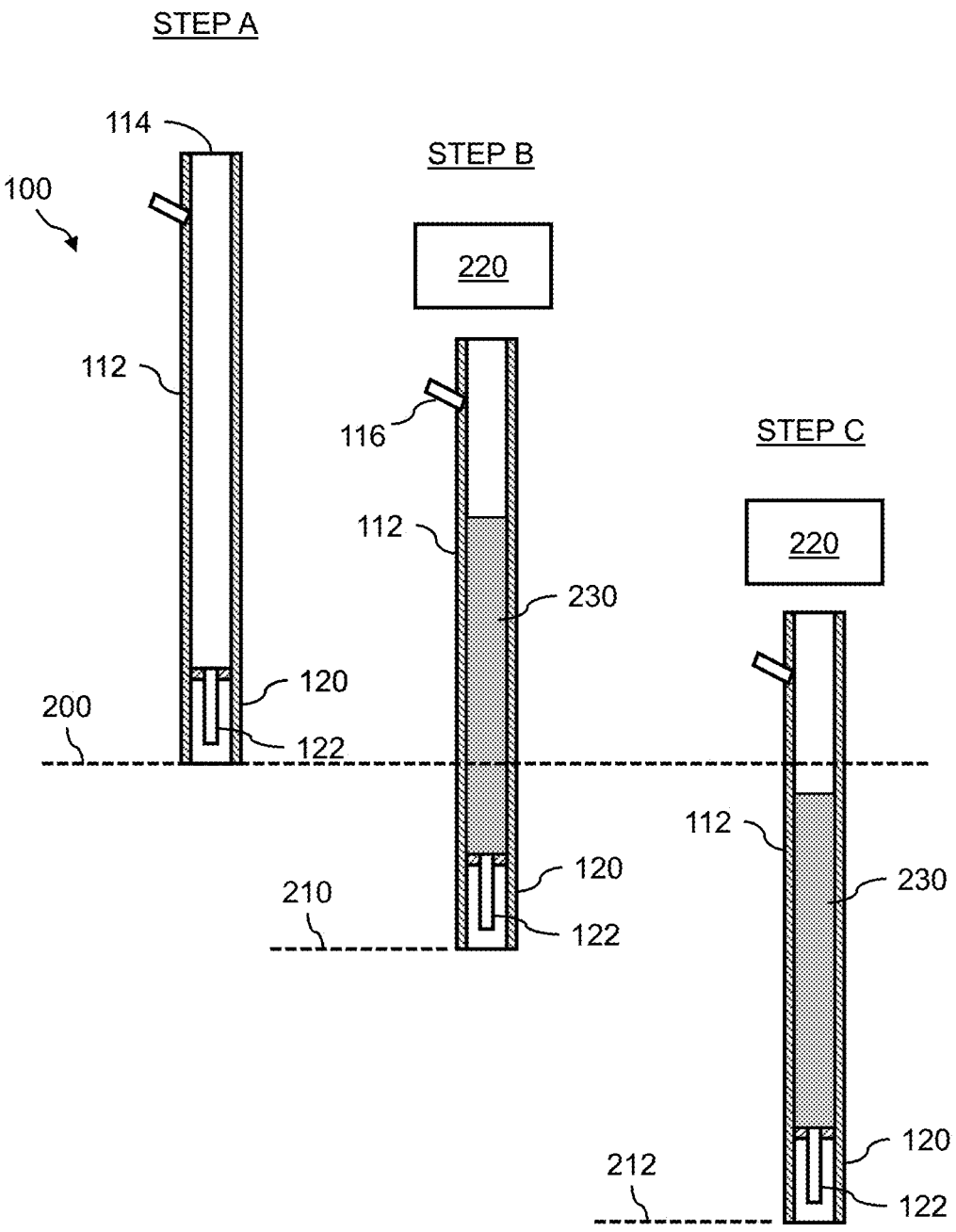
Figure 3B:
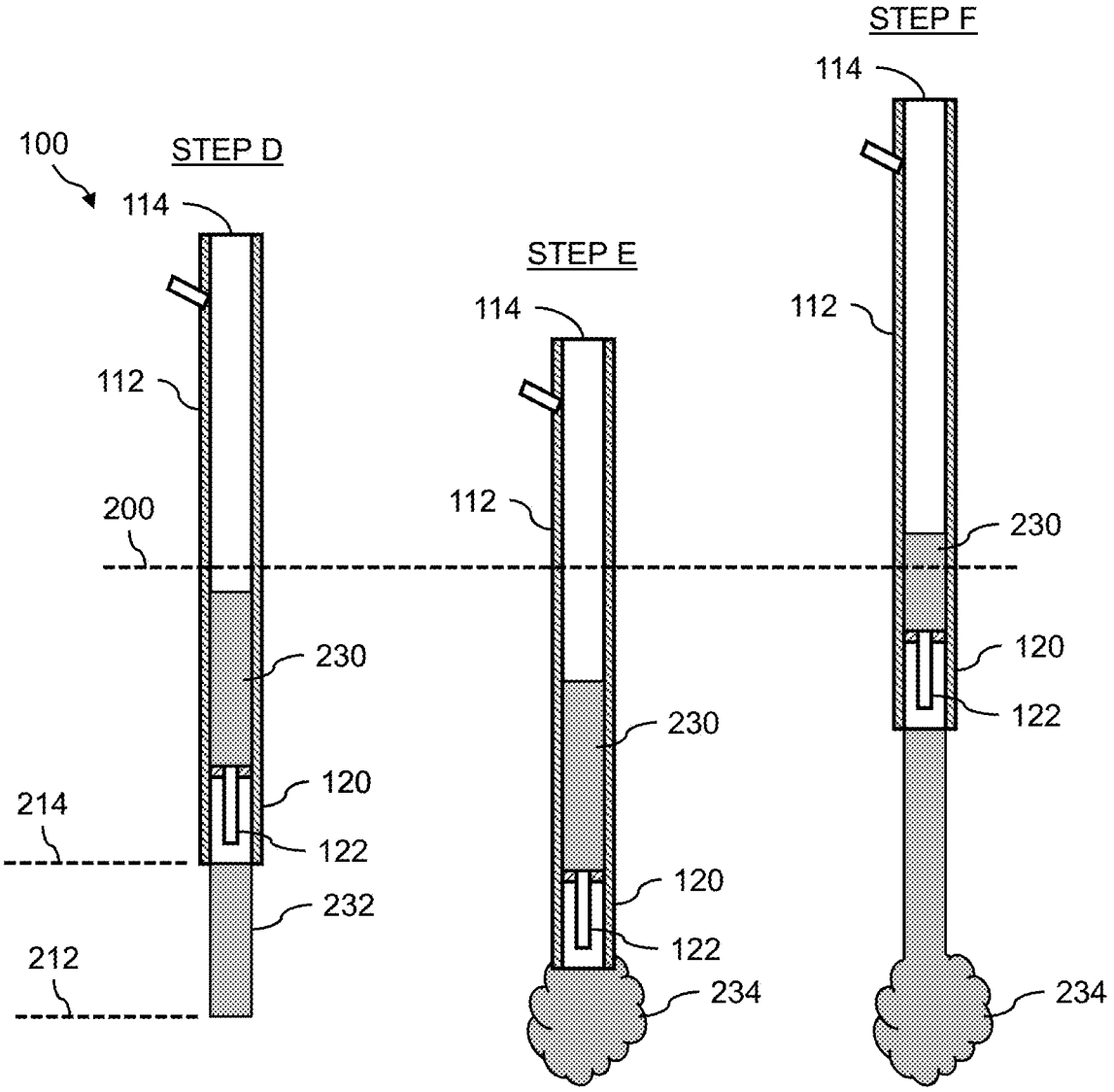
Figure 4A:
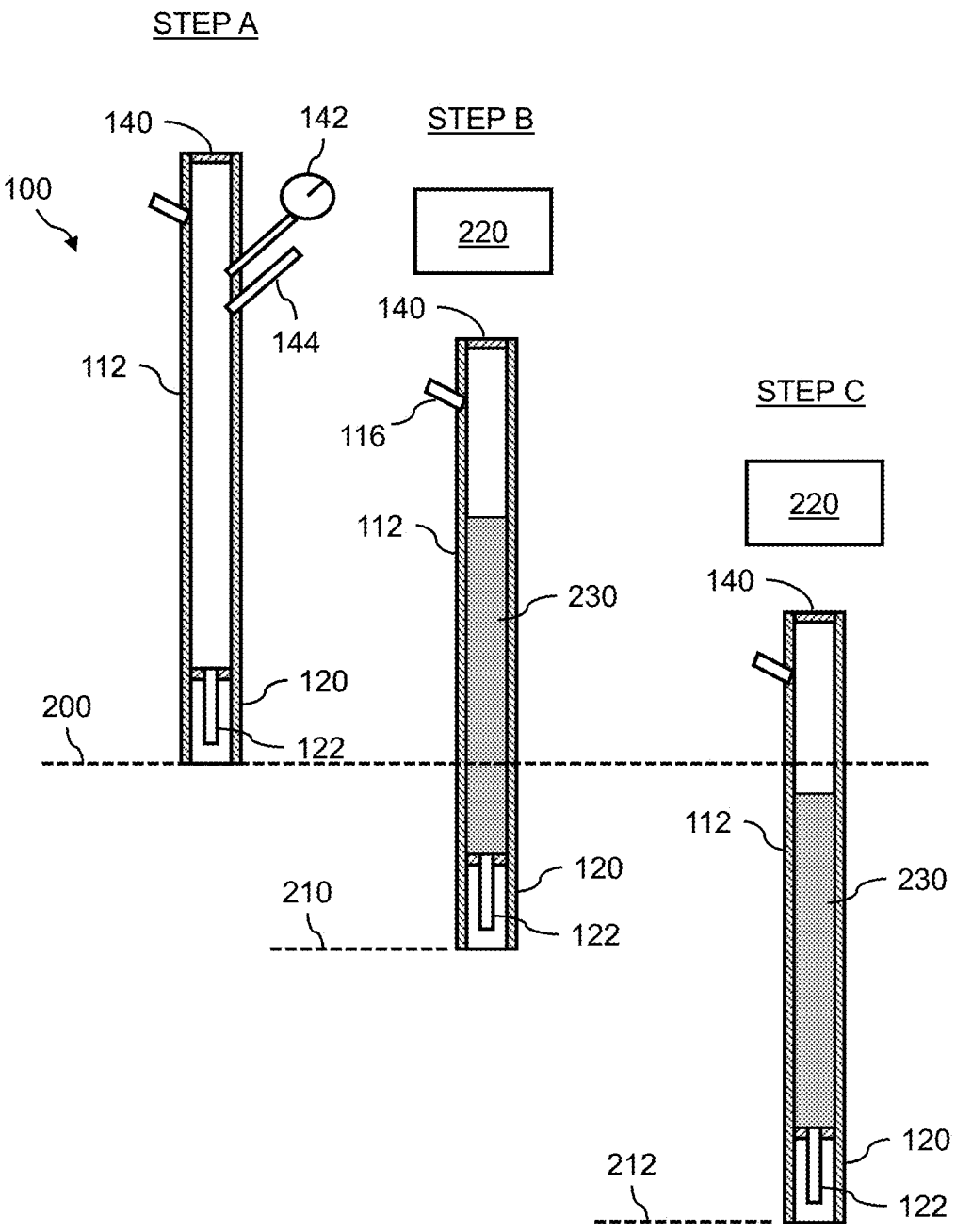
Figure 4B:
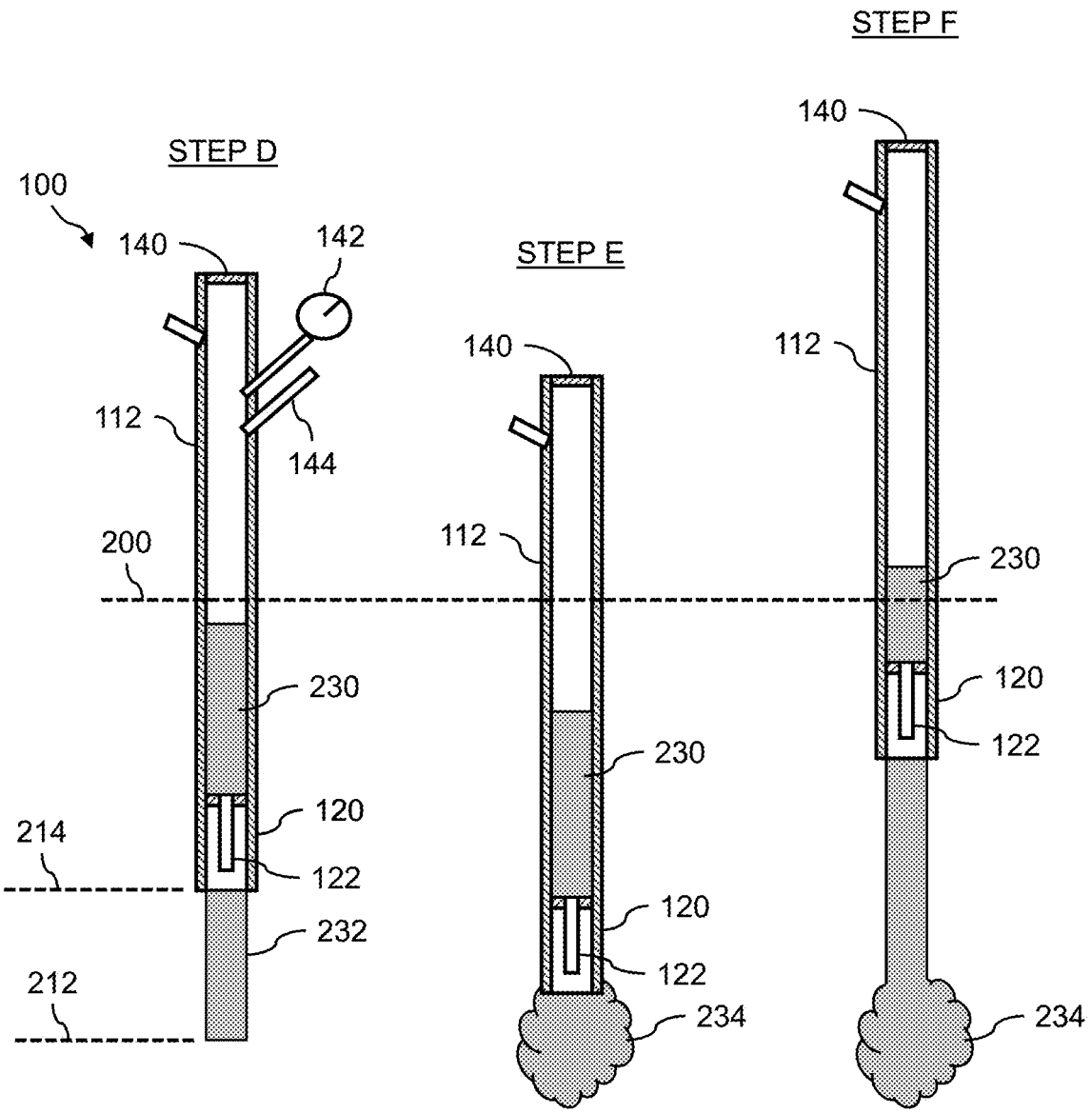
Figure 5:
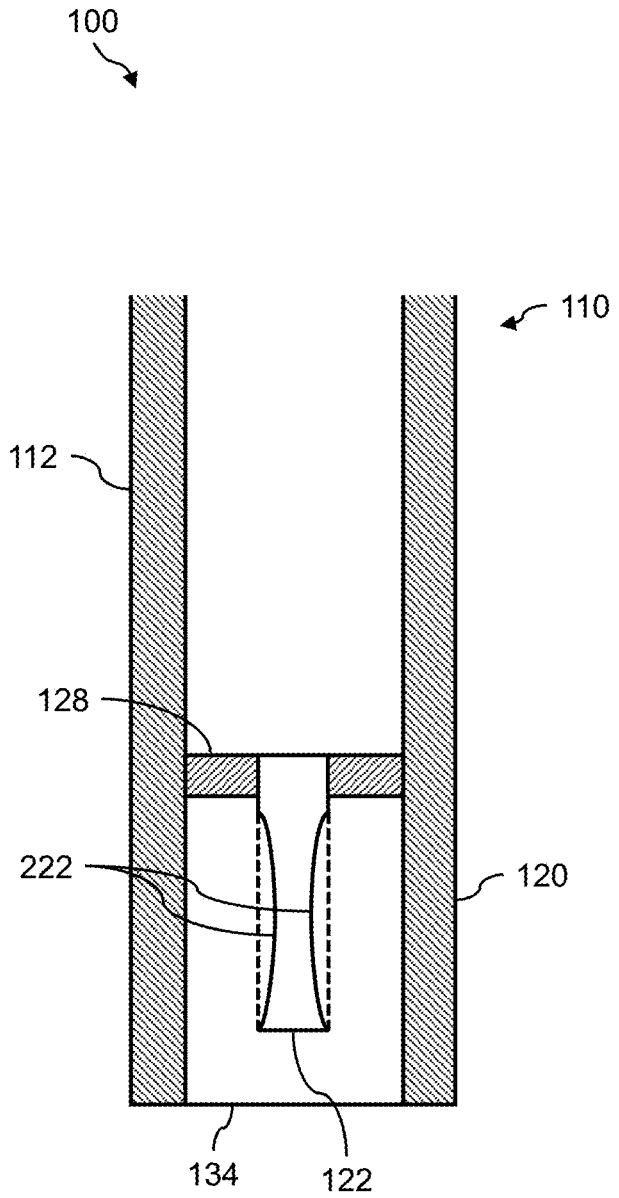

Having thus described the presently disclosed subject matter in general terms, reference will now be made to the accompanying Drawings, which are not necessarily drawn to scale, and wherein:

FIG. 1 illustrates a cross-sectional side view of an example of the presently disclosed driving mandrel for the efficient construction of incrementally enlarged diameter piers;

FIG. 2 illustrates a cross-sectional side view of another example of the presently disclosed driving mandrel for the efficient construction of incrementally enlarged diameter piers;

FIG. 3A and FIG. 3B illustrate an example of a construction process using the driving mandrel shown in FIG. 1 for the efficient construction of incrementally enlarged diameter piers;

FIG. 4A and FIG. 4B illustrate an example of a construction process using the driving mandrel shown in FIG. 2 for the efficient construction of incrementally enlarged diameter piers; and FIG. 5 shows a close-up view of the flexible egress port of the presently disclosed driving mandrel as it is being crimped during re-driving according to the invention.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

The presently disclosed subject matter relates to the efficient construction of ground support columns used to provide support for and control settlements below building foundations, retaining walls, floor slabs, industrial facilities and the like. In some embodiments, the presently disclosed subject matter provides methods and apparatus for forming cemented ground support columns. Namely, driving mandrels are provided for the efficient construction of incrementally enlarged diameter piers. Further, construction methods are provided of using the driving mandrels for the efficient construction of incrementally enlarged diameter piers.

The presently disclosed methods and driving mandrels may be used to efficiently construct cemented piers with low and high mobility infill materials in soft ground conditions while allowing for the construction of incremental expanded diameters at selected depths. The presently disclosed methods and driving mandrels allow for the effective placement and compaction of infill materials strengthened by fibers.

The presently disclosed methods and driving mandrels provide for the efficient construction of cementitious ground reinforcement elements that may be installed with a high degree of construction confidence to provide variable diameters at various depths within the constructed elements. This method is particularly effective because it allows engineers and contractors with a means to optimize the shaft bearing capacity and the geotechnical support capacity for the same element, an advantage not shared by piers or shafts with uniform cross-sections.

The present subject matter provides an improved method and apparatus for constructing cementitious piers. In one embodiment, the driving mandrel contains a specially designed flexible tubular egress port connecting the main body (feed tube) of the driving mandrel with the mandrel bottom-expansion head. The flexible tubular egress port has the advantage that it allows for smooth flow of mobile (fluid) cementitious aggregate materials downward as the tube is filled and then as the tube is lifted upwards. The smooth flow of material is advantageous because it allows for rapid pier construction by facilitating immediate filling of the cavity made by the driving mandrel. The flexible tubular egress port is configured to be sufficiently flexible such that the tube compresses radially inwards and "crimps" as the mandrel is re-driven downwards during pier expansion operations. The crimping that is uniquely allowed by the flexible tubular egress port prevents the backflow of cementitious infill materials upward into the feed tube, thus allowing for pier diameter expansion.

In conventional methods and driving mandrels that do not include upward flow restrictors, placed cementitious materials are compressed within the compaction head. This causes the infill materials to compress and results in upward movement of the infill materials in the compaction head resulting in a decrease in the effectiveness of the expansion of the infill materials to form an expanded bottom bulb. The use of the flexible tubular egress tube of the presently disclosed driving mandrels uniquely retards and restrains upward movements of the cementitious materials because the flexible feed tube bends and crimps, thus preventing upward flow. The prevention of the upward flow of the cementitious infill material allows the expansion chamber to push the cementitious materials downward into the cavity below, thereby effectively resulting in an expanded pier diameter at any depth so selected by the constructor. The expanded pier diameter may be constructed at any elevation along the pier, allowing for the construction of larger piers in soft ground conditions and allowing for the efficient construction of bottom bases using materials with variable mobilities. The purpose of the presently disclosed methods and driving mandrels is to provide a pier construction method that allows high slump concrete and sand-cement/polymer grout mixtures to be placed and expanded below grade with a high degree of precision and confidence.

FIG. 1 shows a cross-sectional side view of a driving mandrel 100 according to a first configuration. The driving mandrel 100 is an example of the presently disclosed driving mandrel for the efficient construction of incrementally enlarged diameter piers. As shown in FIG. 1, the driving mandrel 100 includes a top portion 110 and a feed tube 112. In this embodiment, the top portion 110 is configured with an open upper end 114 to the feed tube 112, an optional inlet injection port 116, and an expansion head portion 118 that is equipped with an expansion (or compaction) chamber 120 and a flexible tubular egress port 122. The feed tube 112 is typically comprised of a cylindrical steel pipe with an inside diameter (ID) 130 and an outside diameter (OD) 132. Other feed tube cross-sectional geometries, such as square, hexagonal, octagonal, and other articulated geometries, are contemplated.

The expansion head portion 118 contains an internal connection ring 128 and the flexible tubular egress port 122 that is affixed to the internal connection ring 128. The flexible tubular egress port 122 may consist of flexible cylindrical tubular material, such as concrete hose, Kevlar tubing, aramid fiber tubing, or other flexible tubular materials. The flexible tubular egress port materials are selected to be sufficiently flexible to allow for crimping during downward driving and sufficiently durable to allow for construction on harsh subsurface environments. The flexible tubular egress port 122 is affixed at the top to the internal connection ring 128 and is configured to extend into the expansion (or compaction) chamber 120. The expansion (or compaction) chamber 120 has an inside diameter (ID) 136 and an outside diameter (OD) 138. The expansion (or compaction) chamber 120 has an open lower surface 134 for placement of cementitious material in the created cavity.

FIG. 2 shows a cross-sectional side view of the driving mandrel 100 according to another configuration. The driving mandrel 100 shown in FIG. 2 is substantially the same as the driving mandrel 100 shown in FIG. 1 except that the top portion 110 of the feed tube 112 is closed via a lid, for example, to form closed upper end 140. Further, this configuration of the driving mandrel 100 may include a pressure gage 142 and a pressure relief valve 144.

FIG. 3A and FIG. 3B shows an example of a construction process using the driving mandrel 100 that is configured according to FIG. 1 (i.e., open upper end 114) for the efficient construction of incrementally enlarged diameter piers. Namely, FIG. 3A and FIG. 3B show, for example, six process steps—STEP A, STEP B, STEP C, STEP D, STEP E, and STEP F.

First, STEP A of FIG. 3A shows the driving mandrel 100 prior to being driven in to the ground wherein the surface of the ground is a ground level 200.

Next, STEP B of FIG. 3A shows the driving mandrel 100 when it is partially driven into the ground to a prescribed initial driving depth 210 with respect to ground level 200 using a conventional piling rig and hammer 220. The driving mandrel 100 is driven to the prescribed initial driving depth 210 and the cementitious backfill is optionally added to the mandrel by pumping into the open upper end 114 of the feed tube 112 or into the optional inlet injection port 116.

Continuing STEP B, when the driving mandrel 100 is driven to the initial driving depth 210, infill material 230, such as high slump concrete or cementitious grout, is then pumped into the driving mandrel 100 through the optional inlet injection port 116 or through the open upper end 114. Cementitious infill materials that are placed within the feed tube 112 are designed with sufficient mobility (fluidity) so that they are easier to mix and pump and flow unimpeded downward through the feed tube 112 and through the bottom flexible tubular egress port 122. Typical cementitious infill materials designed for this purpose may include mobile (medium to high slump) concrete, sand-cement grout, or neat cement grout.

Next, STEP C of FIG. 3A shows the driving mandrel 100 as it is further driven to the prescribed driving termination depth 212 with respect to ground level 200.

Next, STEP D of FIG. 3B shows that after the driving mandrel 100 driven to the prescribed driving termination depth 212, the driving mandrel 100 is then raised and the infill material 230 exits through the flexible tubular egress port 122, into the expansion (or compaction) chamber 120. The infill material 230 exits the flexible tubular egress port 122 by gravity, into the expansion (or compaction) chamber 120, and further into the annual space created at the bottom of the driving mandrel 100 as is it lifted to a lift height 214 with respect to ground level 200 to form placed cementitious material 232. Cementitious infill material 230 easily flows during this installation step because the flexible tubular egress port 122 extends downwards without any constrictions into the expansion (or compaction) chamber 120.

Next, STEP E of FIG. 3B shows the construction of an expanded diameter at selected depth. This occurs when the driving mandrel 100 is re-driven back downwards into the placed cementitious material 232. As the driving mandrel 100 is re-driven downwards the infill material 230 in the expansion (or compaction) chamber 120 compresses and attempts to move upwards and flow back into the feed tube 112. As the cementitious material attempts to flow back into the flexible tubular egress port 122, the flexible tubular egress port 122 constricts and crimps (see FIG. 5) as the result of the upward movement of the infill material 230 as it attempts to flow back upward into the flexible tubular egress port 122. For example, FIG. 5 shows a crimp 222 of the flexible tubular egress port 122 that constricts and prevents backflow into the feed tube 112 thus allowing the expansion (or compaction) chamber 120 to push the placed cementitious material 232 downward and outward into the underlying soil. This forms an expanded diameter portion 234 at depths that are so selected by the constructor. The expanded diameter portion 234 may be constructed at the bottom of the pier to facilitate load transfer to the underling foundation materials or may be constructed at any elevation along the shaft of the constructed pier to create an enlarged cross-sectional area in either weak soil materials or to facilitate additional side shearing resistance that is enacted during structural loading.

Next, STEP F of FIG. 3B shows the driving mandrel 100 as it is then lifted upward allowing for the infill material 230 to flow downward through the flexible tubular egress port 122 and through the expansion (or compaction) chamber 120 to form the shaft of the pier.

FIG. 4A and FIG. 4 shows an example of a construction process using the driving mandrel 100 that is configured according to FIG. 2 (i.e., closed upper end 140) for the efficient construction of incrementally enlarged diameter piers. Namely, FIG. 4A and FIG. 4B show, for example, six process steps—STEP A, STEP B, STEP C, STEP D, STEP E, and STEP F.

First, STEP A of FIG. 4A shows the driving mandrel 100 prior to being driven in to the ground wherein the surface of the ground is the ground level 200.

Next, STEP B of FIG. 4A shows the driving mandrel 100 when it is partially driven into the ground to a prescribed initial driving depth 210 with respect to the ground level 200 using a conventional piling rig and hammer 220.

Continuing STEP B of FIG. 4A, when the driving mandrel 100 is driven to the initial driving depth 210, infill material 230, such as cementitious grout, is then pumped into the driving mandrel 100 through the inlet injection port 116. In this configuration, the driving mandrel 100 includes the lid that is welded to the feed tube 112, for example, to form closed upper end 140. For this configuration, as the infill material 230 enters the feed tube 112, the air that is initially contained within the feed tube 112 is compressed because the apparatus is closed at the bottom by the presence of soil surrounding the bottom of the apparatus and by the closed upper end 140 at the top of the feed tube 112. This causes the air pressure in the feed tube 112 to increase as measured by the air pressure gage 142. Should the air pressure exceed the allowable air pressure within the driving mandrel 100, the air pressure relief valve 144 releases the overpressure into the atmosphere.

Next, STEP C of FIG. 4A shows the driving mandrel 100 as it is further driven to the prescribed driving termination depth 212 with respect to the ground level 200.

Next, STEP D of FIG. 4B shows that after the driving mandrel 100 is driven to the prescribed driving termination depth 212, the driving mandrel 100 is then raised, and the infill material 230 exits through the flexible tubular egress port 122 and then exits the expansion (or compaction) chamber 120 as placed cementitious material 232. In this configuration that includes the closed upper end 140, the air pressure within the feed tube 112 of the driving mandrel 100 extrudes the placed cementitious material 232 out into the annual space created at the bottom of the driving mandrel 100 as is it lifted to the lift height 214 with respect to the ground level 200. Cementitious infill material is easily extruded during this installation step because the flexible tubular egress port 122 extends downwards without any constrictions into the expansion (or compaction) chamber 120. In this configuration, either low-mobility (less fluid) or high-mobility (fluid) cementitious backfill materials may be used.

Next, STEP E of FIG. 4B shows the construction of an expanded diameter portion 234 of the pier when the driving mandrel 100 is re-driven back downwards into the placed cementitious material 232. As the driving mandrel 100 is re-driven downwards the infill material in the expansion (or compaction) chamber 120 is compressed and attempts to flow upwards and flow back into the feed tube 112. When this occurs, the flexible tubular egress port 122 constricts and crimps (see FIG. 5) as the result of the upward movement of the infill material as it attempts to flow back upward into the flexible tubular egress port 122. Again, as shown in FIG. 5, the crimp 222 of the flexible tubular egress port 122 prevents backflow into the feed tube 112 thus allowing the expansion (or compaction) chamber 120 to compact the placed cementitious material 232 and expand the infill material to form an expanded diameter portion 234 at the selected depth. As noted for the first configuration, in this second configuration the expanded diameter portion 234 may be constructed at the bottom of the pier to increase the load transfer to a firm layer or may be constructed at any elevation along the pier to expand the pier into soft soil materials to or to increase load transfer through side shear.

Next, STEP F of FIG. 4B shows the driving mandrel 100 as it is then lifted upward allowing for the infill material 230 to flow downward through the flexible tubular egress port 122 and through the expansion (or compaction) chamber 120 to form the shaft of the pier.

It is well known by those skilled in the art that the formation of cementitious elements below grade is fraught with difficulty and that the formation of support piers with different cross-sectional dimensions is difficult at best. As shown in FIG. 1, FIG. 2 and FIG. 5, the present subject matter provides for the insertion of a flexible tubular egress port 122 that extends from the bottom of the feed tube 112 into the expansion (or compaction) chamber 120.

The flexible tubular egress port 122 (e.g., a flexible tube or hose) should be large enough in area to provide for efficient through-flow but small enough in cross-sectional area to facilitate crimping and bending of the flexible tube during downward mandrel movements. The upper end of the flexible tubular egress port 122 is connected to the feed tube 112 using a variety of different connection details. The flexible tubular egress port 122 extends downward into the expansion (or compaction) chamber 120 to a sufficient length to allow for hose crimping and bending during downward mandrel movements. The tubular egress port materials may consist of many differing grades, strengths, and thicknesses, each containing its own advantages and disadvantages with respect to flowability, crimpability, mobility, bendability, durability, and longevity.

The flexible tubular egress port 122 can be oriented vertically at the center of the feed tube 112 or positioned at one side (i.e., offset from center) of the feed tube 112. The flexible tubular egress port 122 can be positioned vertical or horizontally. The flexible tubular egress port 122 may vary in diameter from about 1 inch (2.5 cm) up to about the inside dimension of the feed tube 112 and generally less than about 36 inches (91 cm). The required length of the flexible tubular egress port 122 as it extends into the expansion (or compaction) chamber 120 depends on the characteristics of the infill material placed, requirements for flow, the diameter of the egress port and other factors. The port length (L) to port diameter (d) ratio (L/d) generally ranges from 1 to 20 with most applications ranging between 2 and 3.

In summary, FIG. 1, FIG. 3A, and FIG. 3B show a first configuration of the presently disclosed driving mandrel 100 whereby the driving mandrel 100 is manufactured using an open upper end 114. An open upper end 114 may consist of a simple opening at the top of the feed tube 112 or an open port extending into a hopper connected to the top of the feed tube 112. In this configuration, cementitious infill material may be added through the optional inlet injection port 116 or through the top of the mandrel feed tube and allowed to flow by gravity through the feed tube 112. If concrete is used as infill material 230, the concrete slump may vary widely with higher slump mixtures corresponding to enhanced mobility, pumpability, and enhanced mandrel flow. Similarly, sand-cement grout mixtures, which provide for relatively easy pumping and flow, may also be used. As shown in FIG. 3A and FIG. 3B, the gravity-fed infill materials flow downward through the feed tube 112 and through the flexible tubular egress port 122 as the driving mandrel 100 is initially driven downward (STEP B of FIG. 3A) and then lifted (STEP D of FIG. 3B). During downward re-driving (STEP E of FIG. 3B), the material in the expansion (or compaction) chamber 120 is pushed upwards against the flexible tubular egress port 122. This causes the port to crimp 222 and bend as shown in FIG. 5. Thus, the flexible tubular egress port 122 acts as an effective valve preventing the upward movement of high-mobility cementitious materials into the feed tube 112, even if the feed tube 112 provides for gravity, not pressurized, flow. The driving mandrel 100 of FIG. 1 and the method of FIG. 3A and FIG. 3B have the advantage that the mandrel design is simpler to construct and operate.

Further, FIG. 2, FIG. 4A, and FIG. 4B show a second configuration of the presently disclosed driving mandrel 100 whereby the driving mandrel 100 is manufactured using a closed upper end 140 at the upper end of the feed tube 112. In this configuration, cementitious infill material is pumped through the inlet injection port 116. If concrete is used as infill material, the concrete slump may vary widely with higher slump mixtures corresponding to enhanced mobility, pumpability, and enhanced mandrel flow. Similarly, sand-cement grout mixtures, which provide for relatively easy pumping and flow, may also be used. As shown in FIG. 4A and FIG. 4B, the infill materials flow downward through the mandrel feed tube 112 and through the flexible tubular egress port 122 as the driving mandrel 100 is initially driven downward (STEP B of FIG. 4A) and then lifted (STEP D of FIG. 4B). During downward re-driving (STEP E of FIG. 4B) the material in the expansion (or compaction) chamber 120 is pushed upwards against the flexible tubular egress port 122. This causes the port to crimp and bend as shown in FIG. 5. Thus, the flexible tubular egress port 122 acts as an effective valve preventing the upward movement of high-mobility cementitious materials into the feed tube 112. The driving mandrel 100 of FIG. 2 and the method of FIG. 4A and FIG. 4B have the advantage that a wide variety of cementitious mix designs may be used for installation.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. An apparatus for constructing a support column, comprising:

a driving mandrel having a top portion, a feed tube, and an expansion head portion that are operatively connected, wherein the expansion head portion comprises an expansion chamber and an egress port within the expansion chamber, the egress port being adapted for crimping wherein the egress port is a tube made of a material, such as concrete hose, Kevlar tubing, or aramid fiber tubing, selected to be sufficiently flexible such that the tube is adapted to compress radially inwards to prevent backflow or infill material upward into the tube.

2. The apparatus as recited in claim 1, wherein the top portion has an open upper end to the feed tube, and the expansion chamber has an open lower surface.

3. The apparatus as recited in claim 1, wherein the expansion head portion includes an internal connection ring, and the egress port is affixed to the internal connection ring and extends into the expansion chamber.

4. The apparatus as recited in claim 1, wherein the top portion has a closed upper end, and the expansion chamber has an open lower surface.

5. The apparatus as recited in claim 4, further comprising an inlet injection port connected to the feed tube.

6. The apparatus as recited in claim 5, further comprising a pressure gauge, and a pressure relief valve that are connected to the feed tube.

7. The apparatus as recited in claim 1, wherein the feed tube has a feed tube inside diameter and a feed tube outside diameter, wherein the expansion chamber has an expansion chamber inside diameter and an expansion chamber outside diameter, the expansion chamber inside diameter being greater than the feed tube outside diameter.

8. A method for constructing a support column, comprising the steps of:

providing a mandrel assembly having a feed tube operatively connected to an expansion head, wherein the expansion head comprises an expansion chamber and an egress port within the expansion chamber, the egress port being adapted for crimping wherein the egress port is a tube made of a material, such as concrete hose, Kevlar tubing, or aramid fiber tubing, selected to be sufficiently flexible such that the tube is adapted to compress radially inwards to prevent backflow or infill material upward into the tube;

driving the mandrel assembly into a ground surface to a prescribed initial depth with respect to the ground surface level;

adding infill material to the feed tube, wherein the infill material has sufficient mobility for advancing within the feed tube and through the egress port;

driving the mandrel assembly further into the ground surface to a prescribed driving termination depth with respect to the ground surface level;

raising the mandrel assembly above the prescribed driving termination depth;

forming a space at the bottom of the mandrel assembly;

allowing a first portion of the infill material to exit through the egress port by gravity into the expansion chamber and into the space; and forming a first placed infill material at the prescribed driving termination depth.

9. The method as recited in claim 8, wherein the adding step is done by pumping the infill material into the feed tube.

10. The method as recited in claim 8, wherein the infill material is mobile medium slump concrete, mobile high slump concrete, sand-cement grout, or neat cement grout.

11. The method as recited in claim 8, further comprising the step of constructing an expanded diameter of the first placed infill material, the constructing step comprising the step of re-driving the raised mandrel assembly downwards into the first placed infill material.

12. The method as recited in claim 11, the constructing step further comprising the steps of:

crimping and constricting by the egress port to prevent upward movement into the egress port by the first placed infill material; and allowing the expansion chamber to push the first placed infill material downward and outward at a prescribed expanded diameter ground depth with respect to the ground surface level.

13. The method as recited in claim 12, further comprising the step of raising the mandrel assembly above the expanded diameter of the first placed infill material.

14. The method as recited in claim 13, further comprising the step of allowing a second portion of the infill material to exit through the egress port by gravity into the expansion chamber.

15. The method as recited in claim 14, further comprising the step of constructing a shaft above the expanded diameter of the first placed infill material.

16. The method as recited in claim 8, further comprising the step of forming a second placed infill material at a different depth than the prescribed driving termination depth.

17. The method as recited in claim 8, further comprising the step of forming a second placed infill material having a different diameter than the first placed infill material and at a different depth than the prescribed driving termination depth.

18. The method as recited in claim 8, further comprising the step of compacting the first placed infill material to have a diameter a larger than the diameter of the expansion chamber.

* * * * *